US008131162B2

(12) United States Patent
Kojo

(10) Patent No.: US 8,131,162 B2
(45) Date of Patent: Mar. 6, 2012

(54) IMAGE FORMING APPARATUS FOR DETECTING A NON-QUALIFIED DEVELOPER CARTRIDGE

(75) Inventor: Hidehiko Kojo, Osaka (JP)

(73) Assignee: Kyocera Mita Corporation (JP)

( * ) Notice: Subject to any disclaimer, the term of this patent is extended or adjusted under 35 U.S.C. 154(b) by 666 days.

(21) Appl. No.: 12/338,397

(22) Filed: Dec. 18, 2008

(65) Prior Publication Data

US 2009/0162078 A1 Jun. 25, 2009

(30) Foreign Application Priority Data

Dec. 21, 2007 (JP) ..... 2007-329786

(51) Int. Cl.
*G03G 15/00* (2006.01)
*G03G 15/08* (2006.01)

(52) U.S. Cl. ..... 399/12; 399/13; 399/27

(58) Field of Classification Search ..... 399/12, 399/13, 27, 30, 49, 258
See application file for complete search history.

(56) References Cited

U.S. PATENT DOCUMENTS 7,194,212 B2 * 3/2007 Kumai et al. ..... 399/12
7,317,880 B2 * 1/2008 Taguchi et al. ..... 399/12
7,725,044 B2 * 5/2010 Kim ..... 399/12
7,787,782 B2 * 8/2010 Takada ..... 399/12
8,014,687 B2 * 9/2011 Sasaki ..... 399/27

FOREIGN PATENT DOCUMENTS

JP 2005-140800 6/2005

* cited by examiner

*Primary Examiner* — William J Royer
(74) *Attorney, Agent, or Firm* — Gerald E. Hespos; Michael J. Porco

(57) ABSTRACT

In a case where a qualified cartridge is not mounted, a toner supply controller stops driving of a toner supply motor. A controller calculates the toner density in a toner tank in accordance with a detection signal of a TC sensor to determine whether the toner density is within an allowable range. In a case where the toner density is out of the allowable range, the toner supply controller allows the toner supply motor to start driving. After that, in a case where the toner density in the toner tank becomes high, a cartridge mounting status determining section determines that a non-qualified cartridge is mounted. On the other hand, in a case where the toner density in the toner tank does not change or becomes lower, the cartridge mounting status determining section determines that the cartridge is not yet mounted.

8 Claims, 3 Drawing Sheets

IMAGE FORMING APPARATUS FOR DETECTING A NON-QUALIFIED DEVELOPER CARTRIDGE

BACKGROUND OF THE INVENTION

1. Field of the Invention

The present invention relates to image forming apparatuses such as a printer, a copying machine, and the like. More particularly, it relates to an image forming apparatus which develops an electrostatic latent image formed on an image bearing member with use of developer containing toners and carriers to form an image.

2. Description of the Related Art

Conventionally, image forming apparatuses such as a printer, a facsimile machine, a copying machine, and the like provided with a developing device which uses two-component developer containing toners and carriers to develop an electrostatic latent image formed on a surface of a photoconductive drum perform image forming by forming a toner image from an electrostatic latent image with use of toner supplied from a cartridge mounted to an apparatus main body and transferring the toner image onto a sheet. When toner in the cartridge runs out, the cartridge is replaced with a new cartridge by a user, so that toner is replenished into the image forming apparatus.

In this case, no problem arises if the newly replaced cartridge is a genuine product of a manufacturer of the image forming apparatus or a product which is qualified by the manufacturer (hereinafter, all of those are referred to as "qualified product"). However, a cartridge which is other than a qualified product (non-qualified product) is used in some cases. If a cartridge which is other than a qualified product is used, an ability of an image forming apparatus is not sufficiently brought out, and it may cause a failure in an image forming apparatus.

Further, as another conventional technology, a management of a cartridge with use of an RFID technology (Radio Frequency Identification) has been adopted in many image forming apparatuses developed in recent years. In this case, a wireless tag which stores information associated with a cartridge and toner as tag information is mounted to the cartridge. After the cartridge is mounted, a communication circuit provided in a main body of the image forming apparatus reads the tag information, so that it can be identified whether the mounted cartridge is a qualified product. In a case where a qualified cartridge is not mounted, a use history thereof is stored in a memory provided in the image forming apparatus. When a failure occurs in the image forming apparatus, a serviceman reads the history, so that the reason for the failure can be analyzed (Japanese Patent Unexamined Publication No. 2005-140800).

SUMMARY OF THE INVENTION

The present invention was made by improving the aforementioned technology.

In summary, an image forming apparatus in accordance with an aspect of the present invention includes: a developing section which develops an electrostatic latent image formed on an image bearing member with a developer; a cartridge which accommodates the developer and is dismountably mounted to an apparatus main body; a supply section which supplies the developer from the cartridge to the developing section; a detector which detects a density of the developer; a supply controller which controls supply of the developer by the supply section in accordance with a detection result of the detector; an identifying section which performs an electrical communication with the cartridge to determine whether a qualified cartridge is mounted to the apparatus main body; and a determining section which determines if a non-qualified cartridge is mounted or the cartridge is not mounted, in a case where the identifying section identifies that the qualified cartridge is not mounted to the apparatus main body, wherein in a case where the identifying section identifies that the qualified cartridge is not mounted to the apparatus main body, the supply controller controls the supply section to stop supply of the developer, and controls the supply section to restart supply of the developer at a point of time when a density of the developer detected by the detector becomes equal to or lower than a predetermined density after the supply of the developer is stopped, and in a case where the density of the developer detected by the detector after the supply of the developer by the supply controller is restarted becomes higher than the density immediately before the supply of the developer by the supply section is restarted, the determining section determines that the non-qualified cartridge is mounted to the apparatus main body, and in a case where the density of the developer detected by the detector does not become high, the determining section determines that the cartridge is not mounted.

These and other objects, features and advantages of the present invention will become more apparent upon reading of the following detailed description along with the accompanied drawings.

DETAILED DESCRIPTION OF THE PREFERRED EMBODIMENT

Hereinafter, an image forming apparatus in accordance with an embodiment of the present invention will be described with reference to the drawings. In the following embodiment, a printer will be described as an example of an image forming apparatus in accordance with the present invention. However, other than a printer, the image forming apparatus may be a copying machine, a complex machine having functions of a copying machine, a scanner, a facsimile machine, and a printer, or the like.

Figure 1:
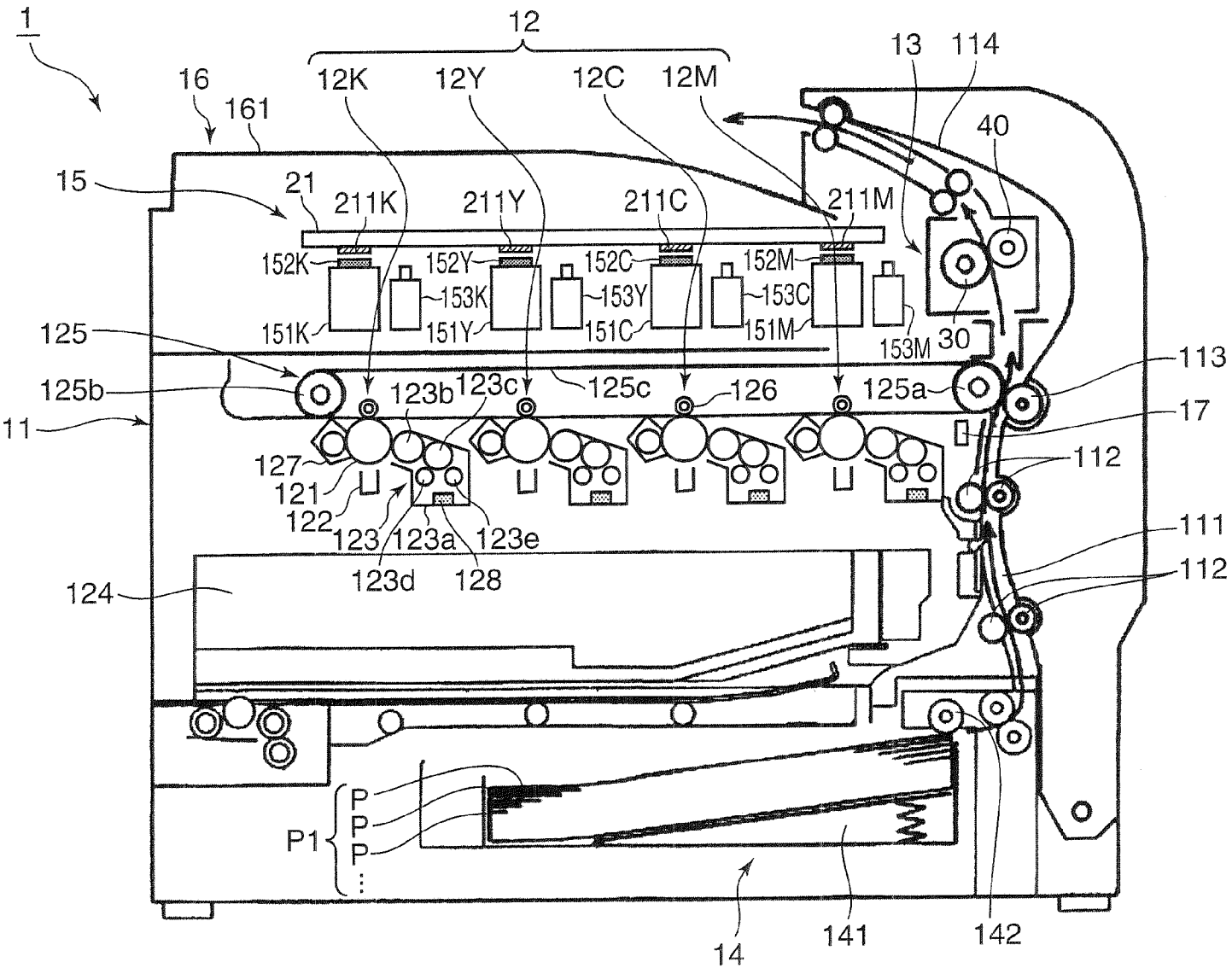
FIG. 1 is a schematic cross-sectional view of a printer.

FIG. 1 is a front cross-sectional view showing an embodiment of an internal configuration of a printer 1 in accordance with the present invention. As shown in FIG. 1, the printer 1 in accordance with the present embodiment includes an apparatus main body 11 having a box-like shape. The apparatus main body 11 is provided with an image forming section 12 which forms an image in accordance with image data transmitted from an external equipment such as a computer, a fixing section 13 which applies fixing processing to a toner image which is formed by the image forming section 12 and transferred to a sheet P as a transferred member, a sheet storage section 14 which stores sheets onto which an image is to be transferred, and a toner supply section 15 which supplies toner to the image forming section 12. On top of the apparatus main body 11, there is provided a sheet discharging section 16 to which the sheet P applied with the fix processing is discharged.

At a suitable portion on an upper surface of the apparatus main body 11, there is provided an operation panel (not shown) for input of output conditions of a sheet P and a display panel (notifying means; not shown) which displays messages and the like for a user. The operation panel is provided with a power key, a start button, setting keys for setting of various functions, and the like.

The sheet storage section 14 is provided with a sheet tray 141 which is detachably inserted at a position under an exposure device 124 in the apparatus main body 11. The sheet tray 141 has a box-shaped body having an open upper side, and a sheet stack P1 including layers of plural sheets P can be stored in the sheet tray 141. An upper surface of a downstream end (right end in FIG. 1) of an uppermost sheet P in the sheet stack P1 stored in the sheet tray 141 is sent out from the sheet stack P1 toward a sheet conveying passage 111 by driving of a pick up roller 142. A sheet P sent out one after another passes through the sheet-conveying passage 111 by driving of a pair of conveying rollers 112 and moves to a nip portion between a second transferring roller 113 and a driving roller 125*a* (intermediate transferring belt 125*c*) in the image forming section 12.

The image forming section 12 is adapted to form a toner image on a sheet P which is supplied from the sheet storage section 14. In the present embodiment, the image forming section 12 includes a black image forming unit 12K using black toner (developer), a yellow image forming unit 12Y using yellow toner, a cyan image forming unit 12C using cyan toner, and a magenta image forming unit 12M using magenta toner. The image forming units 12K, 12Y, 12C, and 12M are provided sequentially from an upstream side (left side in FIG. 1) to a downstream side.

Each image forming unit 12K, 12Y, 12C and 12M includes a photosensitive drum 121 and a charging device 122 which evenly charges a peripheral surface of the photosensitive drum 121. The printer 1 further includes an exposure device 124 which irradiates a laser light in accordance with image data to the peripheral surface of the charged photosensitive drum 121 of each image forming unit 12K, 12Y, 12C and 12M to form an electrostatic latent image on the peripheral surface of the respective photosensitive drum 121. Each image forming unit 12K, 12Y, 12C and 12M further includes a developing device (developing means) 123 which develops the electrostatic latent image formed on the peripheral surface of the photosensitive drum 121 to form a toner image, a transferring roller 126 which transfers the toner image formed on the peripheral surface of the photosensitive drum 121 to the intermediate transferring belt 125*c*, and a cleaning device 127 which removes toner remaining on the peripheral surface of the photosensitive drum 121 after the toner image is transferred.

The developing device 123 includes a toner tank 123*a* which accommodates toner, a developing roller 123*b*, a magnetic roller 123*c*, a paddle mixer 123*d*, a stirring mixer 123*e*, and a TC sensor (detector) 128. The developing roller 123*b* bears toner on its surface and rotates to visualize (develop) the electrostatic latent image formed on the peripheral surface of the photosensitive drum 121 as a toner image. The magnetic roller 123*c* absorbs two-component developer with use of a magnet arranged inside to generate a magnetic brush and supplies toner to the developing roller 123*b*. The paddle mixer 123*d* and the stirring mixer 123*e* have spiral fins respectively and stir the two-component developer while conveying the toner in opposite directions, so that the toner is charged. Further, the paddle mixer 123*d* supplies the two-component developer including charged toner and carrier to the magnetic roller 123*c*.

Further, near a bottom of the toner tank 123*a*, there is provided the TC sensor 128 which is adapted to detect the toner density (carrier/toner ratio) in the toner tank 123*a*. The TC sensor 128 detects the permeability of the toner in the toner tank 123*a* at predetermined time intervals, converts the detected permeability into an electric signal (voltage value), and outputs the electric signal to a controller. The controller calculates the toner density in the toner tank 123*a* in accordance with the electric signal outputted from the TC sensor 128 and outputs a control signal to a toner supply motor 153 (FIG. 2), which will be described hereinafter, to maintain the toner density at an appropriate toner density, so that the amount of toner supplied to the toner tank 123*a* is adjusted.

At a position above the photosensitive drum 121, an intermediate image transferring member 125 is provided. The intermediate image transferring member 125 includes the endless intermediate transferring belt 125*c* extending between the driving roller 125*a* and a driven roller 125*b*, and the peripheral surface of each photosensitive drum 121 comes in contact with the lower side of the intermediate transferring belt 125*c*. The intermediate transferring belt 125*c* rotates between the driving roller 125*a* and the driven roller 125*b* by the transferring rollers 126 provided correspondingly to the respective photosensitive drums 121 in a state of being pressed against the peripheral surfaces of the photosensitive drums 121 and in synchronization with the photosensitive drum 121.

Thus, a toner image of black toner is transferred from the photosensitive drum 121 of the image forming unit 12K to the surface of the intermediate transferring belt 125*c* by the rotation of intermediate transferring belt 125*c*. Subsequently, a toner image of yellow toner is transferred from the photosensitive drum 121 of the image forming unit 12Y to the same position of the intermediate transferring belt 125*c* in superimposition. Subsequently, a toner image of cyan toner is transferred from the photosensitive drum 121 of the image forming unit 12C to the same position of the intermediate transferring belt 125*c* in superimposition. At last, a toner image of magenta toner is transferred from the photosensitive drum 121 of the image forming unit 12M. Accordingly, a color toner image which includes the black toner, the yellow toner, the cyan toner, and the magenta toner is formed in superimposition on the surface of the intermediate transferring belt 125*c*.

Further, at the most downstream side of the intermediate transferring belt 125*c*, there is provided an ID sensor (detecting means) 17. The ID sensor 17 detects the optical density of the toner image transferred to the intermediate transferring belt 125*c*. The ID sensor 17 is, for example, a mirror-reflective type sensor which detects a reflected light. The ID sensor 17 includes an LED light source, which is so arranged as to slant by a predetermined angle with respect to a detection position on the surface of the intermediate transferring belt 125*c*, and a phototransistor as a light-receiving device. The light source irradiates a light to the toner image formed on the intermediate transferring belt 125*c*, and the phototransistor detects the intensity of the reflected light, so that the optical density of the toner image is measured (hereinafter, simply referred to as "density"). The ID sensor 17 converts the measurement result into an electric signal and outputs the electric signal to the controller which will be described hereinafter.

On the right hand position in FIG. 1 of the image forming section 12, there is formed the sheet-conveying passage 111 extending in the vertical direction. On the sheet-conveying passage 111, there are provided the pair of conveying rollers 112 at appropriate positions. A sheet sent out from the sheet storage section 14 is conveyed by driving of the pair of conveying rollers 112 toward the intermediate transferring belt 125*c* wound around the driving roller 125*a*.

On the sheet-conveying passage 111, there is provided the second transferring roller 113 which comes in contact with the surface of the intermediate transferring belt 125*c* at a position facing the driving roller 125*a*. The sheet P conveyed in the sheet-conveying passage 111 is pressed and sandwiched between the transferring belt 125*c* and the second transferring roller 113 so that the toner image on the intermediate transferring belt 125*c* is transferred to the sheet P.

The fixing section 13 is adapted to apply a fixing processing with respect to the toner image transferred to the sheet in the image forming section 12 and includes a heating roller 30 in which an electric heating member such as a halogen lamp is mounted and a pressing roller 40 which is so arranged as to face the peripheral surface of the heating roller 30. The sheet P supplied to the fixing section 13 in a state where the toner image on the intermediate transferring belt 125*c* is transferred passes through a nip portion between the heating roller 30 and the pressing roller 40, each of which rotates. Accordingly, heat is applied from the heating roller 30 to the sheet P so that a fixing processing is applied thereto.

The sheet P to which the fixing processing is applied passes through a sheet-discharging passage 114, which extends from an upper portion of the fixing section 13, and is discharged to a sheet-discharging tray 161 of the sheet-discharging section 16 provided on the top of the apparatus main body 11.

The toner supplying section 15 includes a cartridge 151K for black, a cartridge 151Y for yellow, a cartridge 151C for cyan, and a cartridge 151M for magenta (hereinafter, inclusively referred to as "cartridge 151"), corresponding respectively to the image forming units 12K, 12Y, 12C and 12M of the image forming section 12, and toner supply motors (supplying means) 153K, 153Y, 153C, and 153M (hereinafter, inclusively referred to as "toner supply motor 153") corresponding respectively to the cartridges 151. Each cartridge 151 includes toner of a respective color and is detachable with respect to the apparatus main body 11. When the amount of toner in the cartridge 151 becomes small, toner is replenished to the apparatus main body 11 by replacing the cartridge 151 with a new cartridge 151.

Further, the cartridges 151 include RFID (Radio Frequency-Identification) tags 152K, 152Y, 152C, and 152M (hereinafter, inclusively referred to as "RFID tag 152") respectively. Each RFID tag (wireless tag) 152 includes a memory and a communication circuit. The memory stores item information, such as the number of use of the mounted cartridge 151, specification of accommodated toner, product information such as remaining amount information, and the like, and a unique identification information of the RFID tag 152 (hereinafter, inclusively referred to as "tag information"). The communication circuit transmits the information stored in the memory via an electromagnetic wave. The electromagnetic wave transmitted from the communication circuit is received respectively by corresponding RFID communication units (communication units) 211K, 211Y, 211C, and 211M (hereinafter, inclusively referred to as "RFID communication section 211") on an RFID substrate 21 provided in the apparatus main body 11. The RFID communication section 211 converts the received electromagnetic wave into an electric signal and outputs the electric signal to the controller which will be described hereinafter.

The toner supply motors 153K, 153Y, 153C and 153M drive in accordance with a control signals outputted from the controller, and toner is supplied from the cartridges 151K, 151Y, 151C and 151M to the respective image forming unit 12K, 12Y, 12C and 12M by driving of the associated toner supply motor 153K, 153Y, 153C or 153M.

Figure 2:
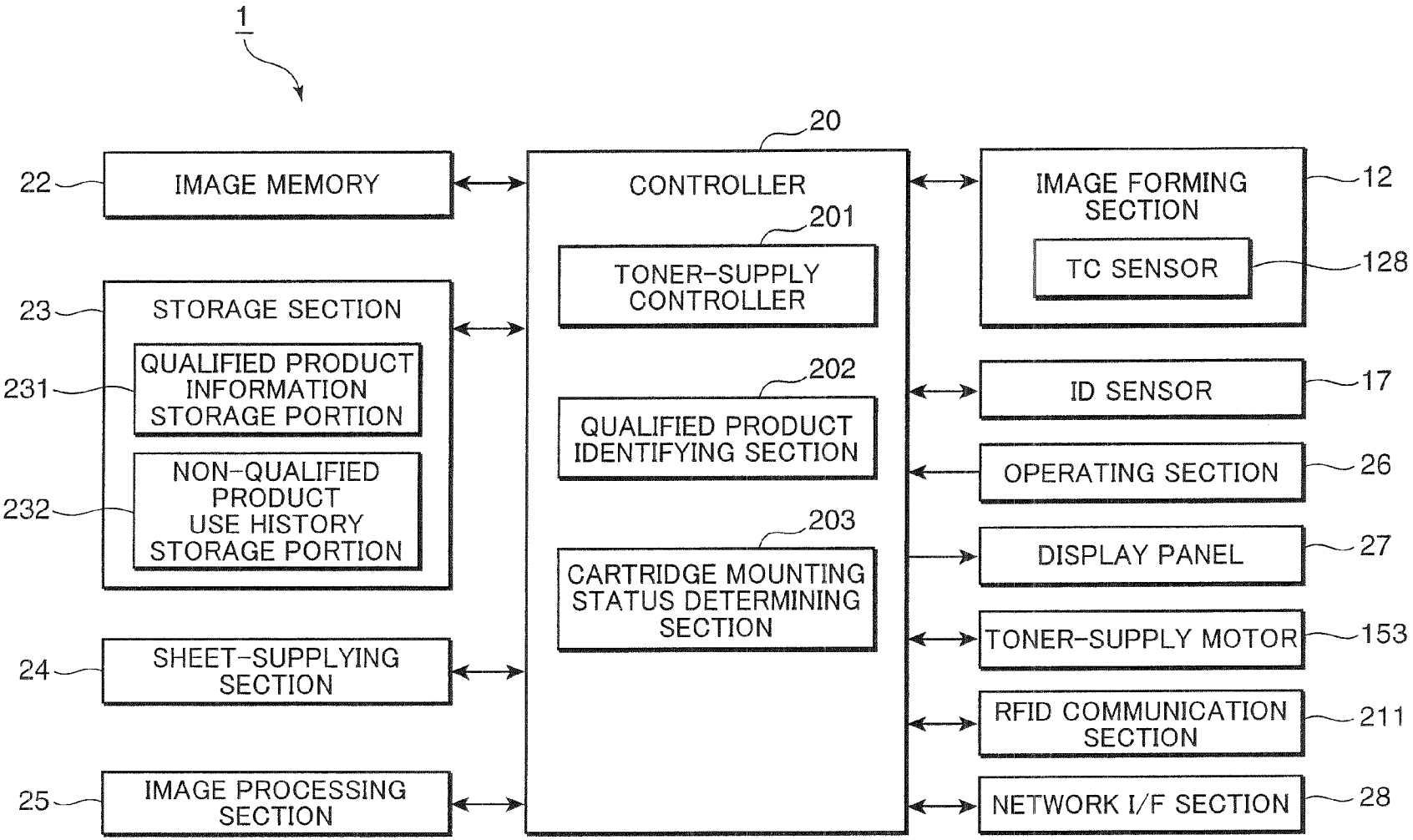
FIG. 2 is a block diagram showing an electric configuration of a printer.

FIG. 2 is a function block diagram showing an electrical configuration of the printer 1 shown in FIG. 1. The printer 1 includes a controller 20, an image memory 22, a storage section 23, a sheet-supplying section 24, the image forming section 12, the ID sensor 17, an image processing section 25, an operating section 26, a display panel (notifying section) 27, the toner supply motor 153, the RFID communication section 211, and a network I/F section 28. The elements depicted in FIG. 1 will be identified by the same reference signs, and detailed description will be omitted.

The controller 20 is configured by a CPU (Central Processing Unit) and the like and totally controls the printer 1 by executing a processing based on a predetermined program in accordance with an inputted instruction signal, outputting the instruction signal to respective functional sections, and transferring data. The controller 20 has a toner supply controller (supply controller) 201, a qualified product identifying section (identifying section) 202, and a cartridge mounting status determining section (determining section) 203.

The toner supply controller 201 inputs a detection signal outputted from a TC sensor 128 to calculate the toner density of toner in the toner tank 123*a* and then outputs a control signal to the toner supply motors 153 so as to maintain the toner density in the toner tank 123*a* to be an appropriate density. The qualified product identifying section 202 compares the tag information, which is received by the RFID communication section 211, with information stored in a qualified product information storage portion 231 of the storage section 23 to determine whether a cartridge mounted to the apparatus main body 11 is a qualified cartridge. In a case where the qualified product identifying section 202 identifies that the qualified cartridge is not mounted to the apparatus main body 11, the cartridge mounting status determining section 203 stops the toner supply motors 153 and determines if a non-qualified cartridge is mounted or a cartridge is not yet mounted, in accordance with a change in the toner density in the toner tank 123*a*.

The image memory 22 temporarily stores image data which is transmitted from an unillustrated external apparatus through the network I/F section 28.

The storage section 23 stores a program, data, and the like for realizing various functions of the printer 1. In the present embodiment, the storage section 23 serves as a qualified product information storage portion 231 and as a non-qualified product use history storage portion 232. The qualified product information storage portion 231 stores tag information which is stored only in the RFID tag 152 mounted to the qualified cartridge (for example, serial number of a cartridge, serial number of a printer, destination information, and the like). The qualified product identifying section 202 compares the tag information read from the RFID tag 152 with the information stored in the qualified product information storage portion 231 to identify whether the mounted cartridge 151 is the qualified product.

The non-qualified product use history storage portion 232 stores a history of mounting a non-qualified cartridge to the apparatus main body 11. The stored contents may be only the date and the number of times a non-qualified cartridge is mounted to the apparatus main body 11 or may be the date and the number of times image forming is actually performed with use of the non-qualified cartridge. Other than this, in a case where a non-qualified cartridge has an RFID tag, and tag information could be received, the tag information may be stored. When a failure occurs in the printer 1, a use history stored in the non-qualified product use history storage portion 232 can be read, so that a serviceman can refer to the history to analyze the reason for the failure.

The sheet-supplying section 24 is configured by a sheet-conveying passage 111 and the like. The sheet-supplying section 24 takes out a sheet P from the sheet tray 141 and conveys the sheet P to the image forming section 12. Then, the sheet P to which a toner image is transferred is conveyed to the fixing section 13. After the fixing is performed, the sheet P is discharged to the sheet-discharging tray 161 through the sheet-discharging passage 114.

The image processing section 25 performs image processing such as correction and enlargement/reduction of an image with respect to image data inputted through the network I/F section 28.

The image forming section 12 forms a toner image with respect to the sheet P supplied from the sheet tray 141 in accordance with image data inputted through the network I/F section 28. Each toner tank 123*a* of a respective developing device 123 is provided with the TC sensor 128, and the TC sensor 128 detects the permeability of toner in the toner tank 123*a* at constant time intervals and outputs a detection signal to the controller 20.

The ID sensor 17 is adapted to optically detect the toner density of a toner image transferred onto the intermediate transferring belt 125*c* and outputs a detection signal to the controller 20.

The operating section 26 includes a power key, a start button, setting keys for setting various functions, and the like and outputs an operation signal to the controller 20. The display panel 27 includes a display screen such as an LCD (Liquid Crystal Display) and displays characters and images in accordance with a display control signal outputted from the controller 20.

The toner supply motor 153K, 153Y, 153C or 153M drives in accordance with a control signal outputted from the toner supply controller 201 to supply toner from the respective cartridge 151K, 153Y, 153C or 153M to the corresponding image forming unit 12K, 12Y, 12C or 12M. The RFID communication section 211 receives an electromagnetic wave transmitted from the RFID tag 152 attached to the cartridge 151, converts the electromagnetic wave into an electric signal, and outputs the electric signal to the controller 20.

The network I/F section 28 is configured by a communication module such as a LAN board and adapted to perform transmission of various data with an external apparatus through a network (not illustrated) connected with the network I/F section 28.

Figure 3:
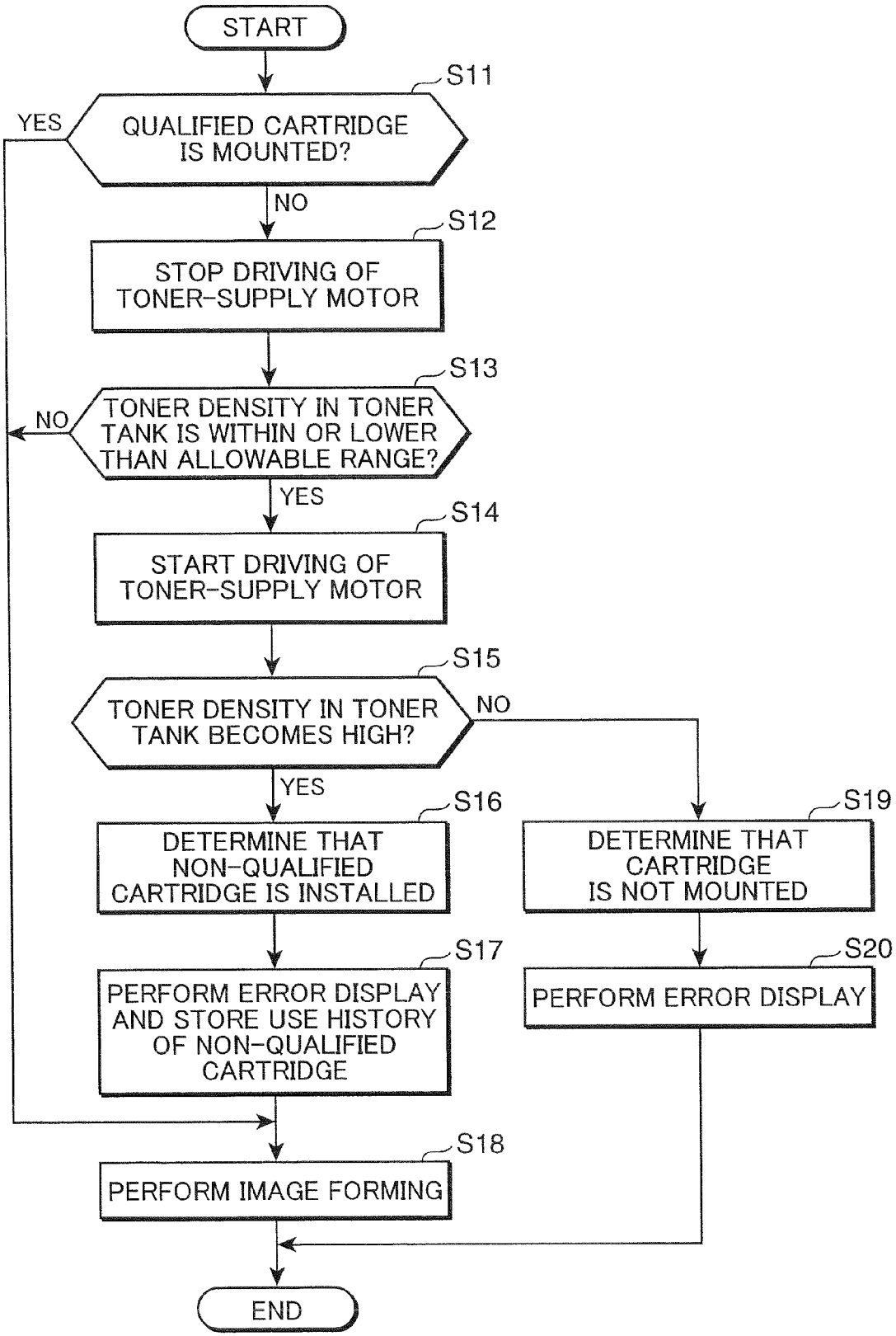
FIG. 3 is a flowchart showing a flow of image forming performed by the printer.

FIG. 3 is a flowchart showing a flow of processing executed at a time when the image forming is performed by the printer 1. Firstly, the qualified product identifying section 202 outputs an instruction signal to the RFID communication section 211 to read tag information from the RFID tag 152 attached to the cartridge 151. The RFID communication section 211, in response to this instruction signal, transmits an electromagnetic wave bearing a signal for requesting tag information to the RFID tag 152. The RFID tag 152, in response to this electromagnetic wave, transmits an electromagnetic wave bearing tag information, and the RFID communication section 211 receives this electromagnetic wave. In a case where the cartridge 151 is not mounted, the RFID tag 152 is not present. Therefore, the RFID communication section 211 surely does not receive the electromagnetic wave transmitted from the RFID tag 152.

The RFID communication section 211 converts the received electromagnetic wave into an electric signal and outputs the electric signal to the qualified product identifying section 202. The qualified product identifying section 202 compares tag information which is included in the electric signal outputted from the RFID communication section 211 with information stored in the qualified product information storage portion 231 to identify if the mounted cartridge 151 is a qualified product (step S11). In a case where the mounted cartridge 151 is a qualified product (step S11; YES), the controller 20 controls the sheet-supplying section 24, the image processing section 25, the image forming section 12, and the like to form an image based on image data inputted to the network I/F section 28 onto the sheet P (step S18).

In a case where the mounted cartridge is not a qualified product (step S11; NO), the toner supply controller 201 stops driving of the toner supply motor 153 (step S12). Accordingly, the supply of toner from the cartridge 151 to the toner tank 123*a* is stopped.

Then, the controller 20 calculates the toner density in the toner tank 123*a* in accordance with a detection signal outputted from the TC sensor 128 and determines whether the toner density is within a predetermined allowable range (step S13). The predetermined allowable range indicates, for example, a range of values which allows a toner image to be formed on the sheet P without degrading the image quality. In a case where the calculated toner density is within the allowable range (step S13; NO), the controller performs image forming with respect to the sheet P (step S18). In a case where the calculated toner density is within or lower than the allowable range (step S13; YES), the toner supply controller 201 allows the toner supply motor 153 to start driving and allows toner to be supplied from the cartridge 151 to the toner tank 123*a* (step S14).

After that (for example, after an elapse of a predetermined time period), the controller 20 calculates the toner density in the toner tank 123*a* again in accordance with a detection signal outputted from the TC sensor 128 (step S15). For example, in a case where the toner density becomes higher than the density immediately before the re-starting of driving of the toner supply motor 153 in step S14 (step S15; YES), the cartridge mounting status determining section 203 determines that the mounted cartridge is a non-qualified product (step S16). The cartridge mounting status determining section 203 allows the display panel 27 to display a message for notifying a user that a non-qualified cartridge is mounted, and stores a history of use of the non-qualified cartridge to the non-qualified product use history storage portion 232 (step S17).

On the other hand, in a case where the calculated toner density does not change from or becomes lower than, for example, the density immediately before the re-starting of driving of the toner supply motor 153 in step S14 (step S15; NO), the cartridge mounting status determining section 203 determines that a cartridge is not mounted (not yet mounted) in the apparatus main body 11 (step S19), and allows the display panel 27 to display a message for notifying a user that a cartridge is not mounted (step S20).

As described above, in the case where the qualified product identifying section 202 identifies that the qualified cartridge is not mounted, driving of the toner supply motors 153 is temporarily stopped. When driving is restarted, change of the density in the toner tank 123*a* is observed. Accordingly, it can be accurately determined if a non-qualified cartridge is mounted, or a cartridge is not yet mounted. In this way, it can be determined whether or not a cartridge is mounted, without providing a sensor, a hard switch, or the like which have been conventionally used for detecting presence or absence of a cartridge. Therefore, the labor and cost for mounting a detecting member can be reduced.

Further, according to the present embodiment, it can be accurately determined if a non-qualified cartridge is mounted, or a cartridge is not yet mounted. Therefore, a use history can be stored in the non-qualified product use history storage portion 232 only in the case where a non-qualified cartridge is mounted. Thus, the reason for the failure of the printer 1 can be analyzed accurately from the use history.

Further, unlike the case of using a method of providing a sensor, a hard switch, or the like for detecting presence or absence of a cartridge, the present invention avoids expense of using the cost and labor to provide detection parts, while preventing a user from using a member to allow an image forming apparatus to identify as if a qualified cartridge is mounted regardless that a non-qualified cartridge is mounted.

Not limited to the configuration of the embodiment, the present invention can be modified in various forms. For example, according to the embodiment, after driving of the toner supply motor 153 is stopped in step S12 of FIG. 3, the controller 20 calculates the toner density in the toner tank 123*a* in accordance with a detection signal outputted from the TC sensor 128 to determine whether the toner density is within the allowable range. However, the controller 20 can use a detection signal which is outputted from the ID sensor 17 instead of the TC sensor 128. In this case, the controller 20 calculates the toner density of the toner image formed on the intermediate transferring belt 125*c* in accordance with a detection signal outputted from the ID sensor 17 to determine whether the toner density is within the allowable range. Similarly, also in step S15 of FIG. 3, the controller 20 may calculate the toner density of a toner image formed on the intermediate transferring belt 125*c* in accordance with a detection signal outputted from the ID sensor 17, and the cartridge mounting status determining section 203 may perform the aforementioned determination in accordance with the change in toner density.

(1) In summary, an image forming apparatus in accordance with an aspect of the present invention includes: a developing section which develops an electrostatic latent image formed on an image bearing member with a developer; a cartridge which accommodates the developer and is dismountably mounted to an apparatus main body; a supply section which supplies the developer from the cartridge to the developing section; a detector which detects a density of the developer; a supply controller which controls supply of the developer by the supply section in accordance with a detection result of the detector; an identifying section which performs an electrical communication with the cartridge to determine whether a qualified cartridge is mounted to the apparatus main body; and a determining section which determines if a non-qualified cartridge is mounted or the cartridge is not mounted, in a case where the identifying section identifies that the qualified cartridge is not mounted to the apparatus main body, wherein in a case where the identifying section identifies that the qualified cartridge is not mounted to the apparatus main body, the supply controller controls the supply section to stop supply of the developer, and controls the supply section to restart supply of the developer at a point of time when a density of the developer detected by the detector becomes equal to or lower than a predetermined density after the supply of the developer is stopped, and in a case where the density of the developer detected by the detector after the supply of the developer by the supply controller is restarted becomes higher than the density immediately before the supply of the developer by the supply section is restarted, the determining section determines that the non-qualified cartridge is mounted to the apparatus main body, and in a case where the density of the developer detected by the detector does not become high, the determining section determines that the cartridge is not mounted.

In a case where identifying means identifies that a qualified cartridge is not mounted to an apparatus main body, the following cases may be presumed. A non-qualified cartridge is mounted, or a cartridge is not yet mounted. In this case, according to the present invention, it can be determined if a non-qualified cartridge is mounted, or a cartridge is not yet mounted, without using a sensor or a hard switch to detect presence or absence of a cartridge. For example, a mounting state of a cartridge can be accurately determined without labor and cost for providing a detection member such as a sensor and a hard switch.

Further, according to the present invention, in a case where the identifying section determines that the qualified cartridge is not mounted to the apparatus main body, the supply controller controls the supply section to stop the supply of developer. The image forming performed by the image forming apparatus is continued until the developer density detected by the detector becomes equal to or lower than the predetermined density. Therefore, for example, even in the case where a non-qualified cartridge is mounted, the image forming with use of developer supplied from the qualified cartridge is continued to a maximum extent, and image forming with use of developer which is supplied from a non-qualified cartridge and being unclear whether it is suitable for the image forming apparatus is avoided. Accordingly, high-quality image forming is maintained.

(2) Further, according to an aspect of the present invention, the detector is a TC sensor which detects a carrier/toner ratio of the developer.

According to this invention, it can be determined if the non-qualified cartridge is mounted, or a cartridge is not yet mounted, with use of a TC sensor originally provided in an image forming apparatus, without adding a separate mechanism.

(3) Further, an image forming apparatus in accordance with an aspect of the present invention further includes: a transferring belt which includes a belt-like member running in an endless manner; and a transferring section which transfers a toner image, which is developed by the developing section from an electrostatic latent image formed on the image bearing member, onto the transferring belt, and the detector is an ID sensor which detects a density of the toner image transferred by the transferring section onto the transferring belt.

According to this invention, it can be determined if the non-qualified cartridge is mounted, or a cartridge is not yet mounted, with use of an ID sensor originally provided in an image forming apparatus, without adding a separate mechanism.

(4) Further, an image forming apparatus in accordance with an aspect of the present invention further includes: a storage section which stores, in a case where the determining section determines that the non-qualified cartridge is mounted to the apparatus main body, a record indicating that the non-qualified cartridge is mounted, and stores, in a case where the determining section determines that the cartridge is not mounted to the apparatus main body, a record indicating that the cartridge is not mounted to the apparatus main body.

According to this invention, a record indicating if a non-qualified cartridge is mounted, or a cartridge is not yet mounted is stored in a storage section. Accordingly, when a failure occurs in the image forming apparatus, the reason of the failure can be accurately analyzed by reading the record.

(5) Further, an image forming apparatus in accordance with an aspect of the present invention further includes: a notifying section which notifies to a user a message in accordance with a determination result of the determining section.

(6) Further, according to an aspect of the present invention, the notifying section notifies that the non-qualified cartridge is mounted in a case where the determining section determines that the non-qualified cartridge is mounted to the apparatus main body.

(7) Further, according to an aspect of the present invention, the notifying section notifies that the cartridge is not mounted in a case where the determining section determines that the cartridge is not mounted to the apparatus main body.

According to these inventions, it can be accurately notified to a user if a non-qualified cartridge is mounted, or a cartridge is not yet mounted.

(8) Further, an image forming apparatus in accordance with an aspect of the present invention further includes: a wireless tag which is provided in the cartridge and stores tag information, and the identifying section has a communication section, which uses a wireless communication to read the tag information stored in the wireless tag, and uses the tag information read by the communication section to identify whether or not the qualified cartridge is mounted to the apparatus main body.

According to this invention, it can be easily identified electronically with use of a wireless tag whether the mounted cartridge is a qualified cartridge.

This application is based on Japanese Patent application serial No. 2007-329786 filed in the Japan Patent Office on Dec. 21, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a developing section which develops an electrostatic latent image formed on an image bearing member with a developer;

a cartridge which accommodates the developer and is dismountably mounted to an apparatus main body;

a supply section which supplies the developer from the cartridge to the developing section;

a detector which detects a density of the developer;

a supply controller which controls supply of the developer by the supply section in accordance with a detection result of the detector;

an identifying section which performs an electrical communication with the cartridge to determine whether a qualified cartridge is mounted to the apparatus main body; and a determining section which determines if a non-qualified cartridge is mounted or the cartridge is not mounted, in a case where the identifying section identifies that the qualified cartridge is not mounted to the apparatus main body, wherein the supply controller controls the supply section to stop supply of the developer, and controls the supply section to restart supply of the developer at a point of time when a density of the developer detected by the detector becomes equal to or lower than a predetermined density after the supply of the developer is stopped, and in a case where the density of the developer detected by the detector after the supply of the developer by the supply controller is restarted becomes higher than the density immediately before the supply of the developer by the supply section is restarted, the determining section determines that the non-qualified cartridge is mounted to the apparatus main body, and in a case where the density of the developer detected by the detector does not become high, the determining section determines that the cartridge is not mounted.

2. The image forming apparatus according to claim 1, wherein the detector is a TC sensor which detects a carrier/toner ratio of the developer.

3. The image forming apparatus according to claim 1, further comprising:

a transferring belt which includes a belt-like member running in an endless manner; and a transferring section which transfers a toner image, which is developed by the developing section from an electrostatic latent image formed on the image bearing member, onto the transferring belt, wherein the detector is an ID sensor which detects a density of the toner image transferred by the transferring section onto the transferring belt.

4. The image forming apparatus according to claim 1, further comprising:

a storage section which stores, in a case where the determining section determines that the non-qualified cartridge is mounted to the apparatus main body, a record indicating that the non-qualified cartridge is mounted, and stores, in a case where the determining section determines that the cartridge is not mounted to the apparatus main body, a record indicating that the cartridge is not mounted to the apparatus main body.

5. The image forming apparatus according to claim 1, further comprising:

a notifying section which notifies to a user a message in accordance with a determination result of the determining section.

6. The image forming apparatus according to claim 5, wherein the notifying section notifies that the non-qualified cartridge is mounted in a case where the determining section determines that the non-qualified cartridge is mounted to the apparatus main body.

7. The image forming apparatus according to claim 5, wherein the notifying section notifies that the cartridge is not mounted in a case where the determining section determines that the cartridge is not mounted to the apparatus main body.

8. The image forming apparatus according to claim 1, further comprising:

a wireless tag which is provided in the cartridge and stores tag information, wherein the identifying section has a communication section, which uses a wireless communication to read the tag information stored in the wireless tag, and uses the tag information read by the communication section to identify whether or not the qualified cartridge is mounted to the apparatus main body.

* * * * *